US006089054A

United States Patent [19]

Stukas et al.

[11] Patent Number: 6,089,054

[45] Date of Patent: Jul. 18, 2000

[54] SKI LOCK ASSEMBLY

[76] Inventors: Alfred A. Stukas, 303 Wyndale Rd., Rochester, N.Y. 14617; Dante DiProsa, 56 Charrington Rd., Rochester, N.Y. 14609

[21] Appl. No.: 09/231,269

[22] Filed: Jan. 15, 1999

[51] Int. Cl.[7] ..... E05B 73/00

[52] U.S. Cl. ..... 70/18; 70/30; 70/58

[58] Field of Search ..... 70/30, 18, 49, 70/58, 233

[56] References Cited

U.S. PATENT DOCUMENTS

| | | | |
|---|---|---|---|
| 4,665,724 | 5/1987 | Sakai | 70/30 |
| 4,970,882 | 11/1990 | Arrendondo | 70/30 |
| 5,063,762 | 11/1991 | Vandeweghe | 70/30 |
| 5,251,464 | 10/1993 | Halter | 70/30 |
| 5,255,546 | 10/1993 | Saunders et al. | 70/30 X |
| 5,289,704 | 3/1994 | Johnson | 70/30 |
| 5,306,046 | 4/1994 | Stanley | 70/30 X |
| 5,367,785 | 11/1994 | Benarroch | 70/30 X |
| 5,832,752 | 11/1998 | Zeller | 70/30 |

FOREIGN PATENT DOCUMENTS

| | | | |
|---|---|---|---|
| 476260 | 3/1992 | European Pat. Off. | 70/30 |

*Primary Examiner*—Lloyd A. Gall
*Attorney, Agent, or Firm*—Howard J. Greenwald

[57] ABSTRACT

A locking assembly for personal property, which contains a body with a base, the body being connected to a combination lock with a retractable cable, a first bracket removably attached to said body, and a second bracket removably attached to the body. Each of the first bracket and the second bracket forms an orifice with a centerline. A line drawn through the centerlines of the brackets forms an angle with respect to the base of from about 8 to about 15 degrees.

5 Claims, 10 Drawing Sheets

SKI LOCK ASSEMBLY

FIELD OF THE INVENTION

An apparatus for locking skis and ski poles comprised of a locking assembly attached to at least one of the ski poles.

BACKGROUND OF THE INVENTION

Retractable locking assemblies for securing equipment such as ski poles, skis, and the like are well known. Thus, by way of illustration, U.S. Pat. No. 5,063,762 of Catherine M. Vanderweghe discloses a locking assembly external to, and mounted on, a portable or riding device.

The locking assembly described in the Vanderweghe patent is less than ideal. In the first place, it is rather cumbersome to use, requiring locking structure on each of two separate ski poles. Furthermore, because it involves the digital manipulation of several small parts, such as a rewind button 14 and a retractable cover 16, it is often difficult to manipulate by one whose fingers are numbed.

It is an object of this invention to provide a locking structure for ski poles and skis which is relatively easy to use and unobtrusive.

It is another object of this invention to provide a lock which is not attached to one or more ski pole handles and can readily be transferred from one ski pole to another.

SUMMARY OF THE INVENTION

In accordance with the invention, there is provided a locking assembly for securing personal property such as, e.g., ski poles and skis which comprises a body comprising a retractable cable and a combination lock, a first bracket attached to said body, and a shim disposed within said first bracket.

BRIEF DESCRIPTION OF THE DRAWINGS

The invention will be described by reference to the specification and to the enclosed drawings, in which like reference numerals refer to like elements, and in which.

DESCRIPTION OF THE PREFERRED EMBODIMENTS

Figure 1:
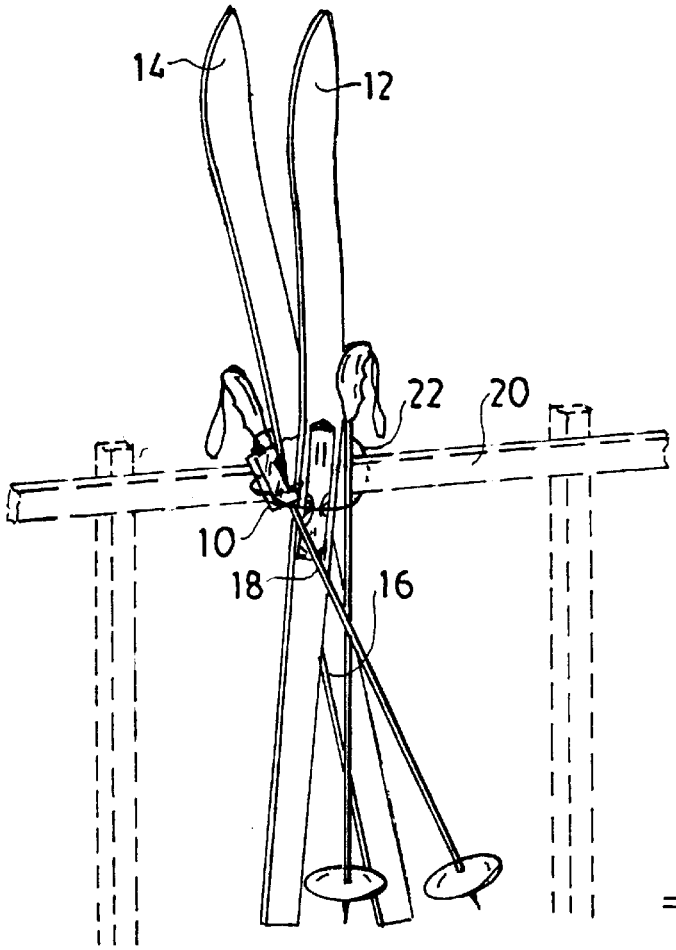
FIG. 1 is a perspective view of one preferred locking device of this invention securing two ski poles and two skis to a stand.

FIG. 1 is a perspective view of a locking assembly 10 which, in the preferred embodiment depicted, is being used to secure skis 12 and 14 and ski poles 16 and 18 to stand 20. In the preferred embodiment depicted, locking assembly 10 is attached to ski pole 18, and a retractable cable 22 from locking assembly 10 extends from locking assembly 10, around ski pole 18, ski 12, ski pole 16, stand 20, and ski 14, and then back to the locking assembly 10, wherein it is secured.

Figure 2:
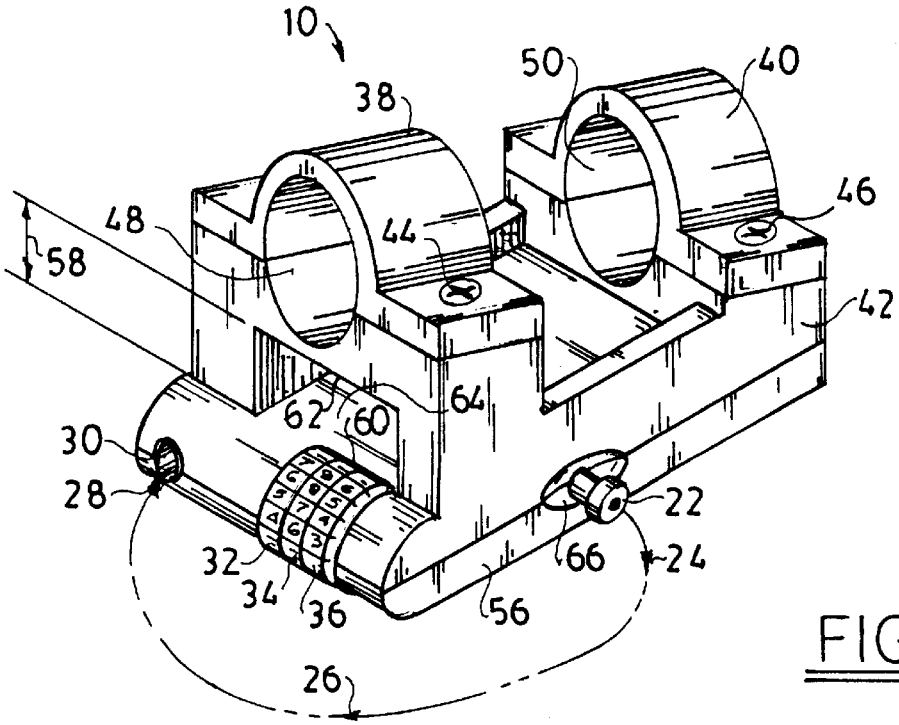
FIG. 2 is a perspective view of the locking device of FIG. 1.
Figure 7:
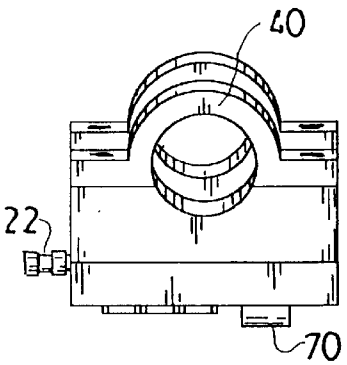
FIG. 7 is a back view of the locking device of FIG. 1.

FIG. 2 is a perspective view of locking assembly 10. It will be seen that retractable cable 22 may be extended in the direction of arrows 24, 26, and 28 and secured within keyhole orifice 30. The skis 12 and 14, the ski poles 16 and 18, and the stand 20 which the cable 22 is wrapped around have been omitted from FIG. 2 for the sake of simplicity of representation. It will be understood, however, that cable 22 preferably, when fully extended, is from about 1 to about 3 feet long and, more preferably, from about 20 to about 28 inches.

One may use any cable in the locking assembly 10 that will serve the desired function. Thus, as used in this specification, the term cable includes cables made from metal materials, elastomeric materials, and any other materials commonly used in industry exhibiting the traits of strength of flexibility. The preferred cable material is a braided metallic structure.

Referring again to FIG. 2, once the cable 22 has been secured within keyhole 30, it is lockably secured therein and only can be removed upon the alignment of the proper combination numbers in tumblers 32, 34, and 36.

One may use any conventional cable lock with a retractable cable for the assembly depicted in FIG. 2. Thus, by way of illustration and not limitation, one may use one or more of the assemblies disclosed in U.S. Pat. Nos. 5,063,762, 4,543,806 (retractable cable lock), U.S. Pat. No. 3,950,972 (lock with retractable cable), U.S. Pat. No. 3,906,815 (retractable cable assembly and lock), D272,986 (combination lock with retractable cable), and the like. The disclosure of each of these United States patents is hereby incorporated by reference into this specification.

Combination locks with retractable cables are readily commercially available and may be purchased, e.g., as a "RECOILER" lock, manufactured by the Ski Tote U.S.A. of 161 Plaza LaVista, Camarillo, Calif. 93010. Similar ski locks may be purchased under the name of "KRYPTONITE."

In one embodiment, the combination lock with retractable cable is manufactured by the Sinox Company of Taiwan and sold as part number PL966.

Referring again to FIG. 2, and in the preferred embodiment therein, it will be seen that locking assembly 10 is comprised of a first bracket 38 and a second bracket 40, each of which is removably attached to body 42. In the embodiment depicted, the brackets 38 and 40 are removably attached by means of screws 44 and 46, and also by means of other screws (not shown in FIG. 1).

Referring again to FIG. 2, and in the preferred embodiment depicted, it will be seen that first bracket 38 defines an orifice 48, and the second bracket 40 defines an orifice 50. The orifices 48 and 50 define an angled path for a ski pole. Thus, referring to FIG. 4, when a line 52 is drawn through the center of orifices 48 and 50, it will preferably form an angle 54 with the base 56 of the locking device 10 of from about 8 to about 15 degrees and, more preferably, from about 9 to about 12 degrees. Thus, the ski pole (not shown in FIG. 2) disposed within orifices 48 and 50 diverges away from tumblers 32, 34, and 36 and thus gives one more ready access thereto. Additionally, it is preferred that the distance 58 between the top 60 of tumblers 32, 34, and 36 and the bottom 62 of notch 64 be at least about 0.25 inches and, more preferably, is from about 0.3 to 0.65 inches.

In another embodiment, not shown, the first bracket 38 and the second bracket 40 are combined into one bracket (not shown).

It is preferred that the body 42 of the locking assembly 10, and the brackets 38 and 40, consist essentially of plastic material. In one preferred embodiment, the plastic material used is a polyester, and most preferably a elastomeric material which consists essentially of polyester. By way of illustration and not limitation, one suitable polyester elastomer is sold by the E.I. duPont deNemours Company of Wilmington, Del. as ST801.

Figure 3:
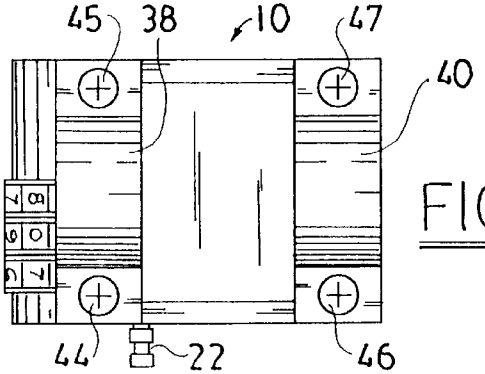
FIG. 3 is top view of the locking device of FIG. 1.

FIG. 3 is a top view of locking assembly 10, illustrating how screws 44, 45, 46, and 47 secure the brackets 38 and 40. In one preferred embodiment, screws 44, 45, 46, and 47 are substantially rust-proof screws such as those which are coated with "black oxide 632". Alternatively, or additionally, one may use stainless steel screws.

Figure 4:
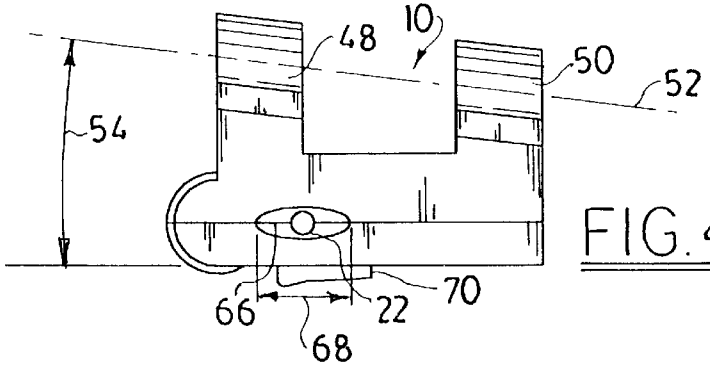
FIG. 4 is a side view of the locking device of FIG. 1.
Figure 5:
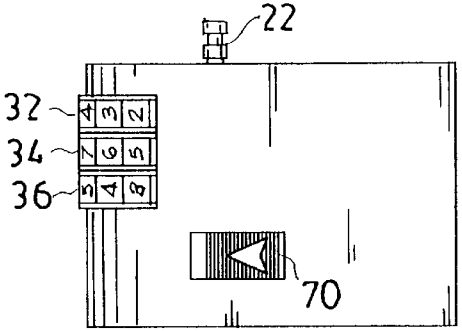
FIG. 5 is bottom view of the locking device of FIG. 1.
Figure 6:
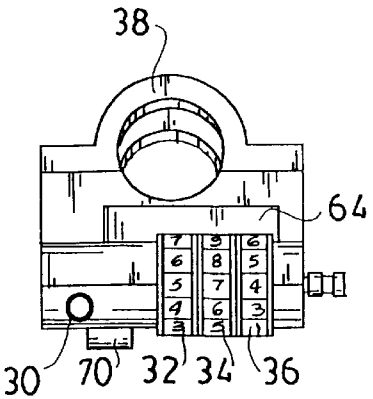
FIG. 6 is a front view of the locking device of FIG. 1.

FIG. 4 is a side view of the locking device 10. In the preferred embodiment depicted in FIG. 4, it will be seen that cable 22 is disposed within a notch 66 which preferably has a length 68 of at least about 0.7 inches and a height of at least about 0.3" to allow ready access to the cable 22. In one embodiment, the notch 66 may be as large as, e.g., 1.0" by about 0.5".

Referring again to FIG. 4, it will be seen that device 10 is comprised of a button 70 which, when depressed, will release the locking mechansim (not shown in FIG. 4) and, additionally, will release the tension on the cable 22.

Figure 8:
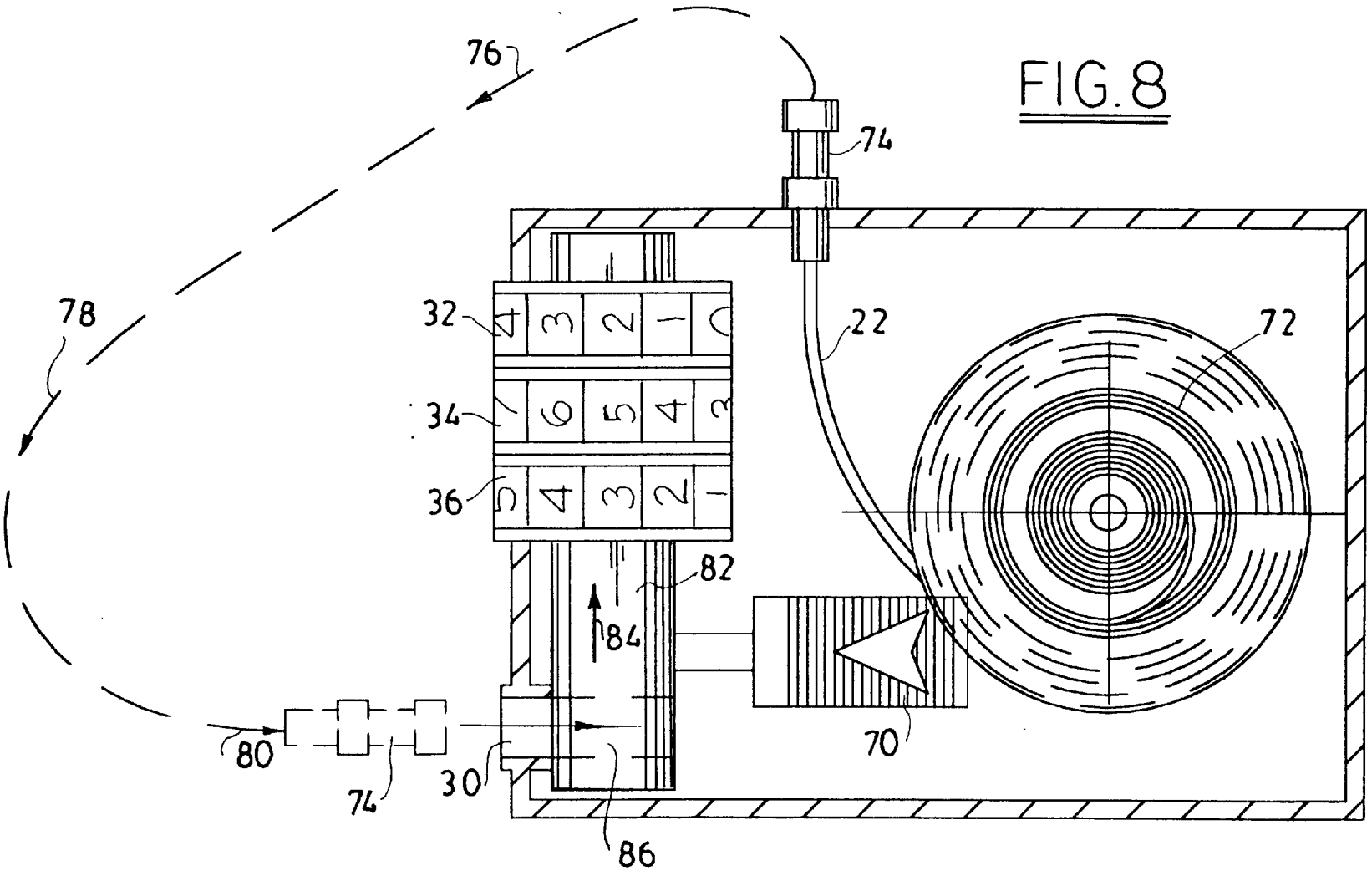
FIG. 8 is a schematic view of the interior of the locking device of FIG. 1.

FIG. 8 is a schematic view of one preferred locking mechanism. Referring to FIG. 8, it will be seen that cable 22 is wound around spring-loaded reel assembly. Cable locks with spring-loaded reel assemblies are well known to those skilled in the art and are described, e.g., in U.S. Pat. No. 5,653,467 (spring loaded reel with gear lock), U.S. Pat. Nos. 4,566,198, 4,404,822 (cable lock with spring loaded reel), U.S. Pat. No. 4,086,795 (cable lock with spring loaded reel), and the like. The disclosure of each of these United States patents is hereby incorporated by reference into this specification.

Referring again to FIG. 8, it will be seen that cable 22 is equipped with a locking tab 74 which may be withdrawn in the direction of arrows 76, 78, and 80 and removably locked within keyhole orifice 30. Once so locked, it may be disengaged when release button 70 is depressed.

In the mechanism depicted in FIG. 8, when button 70 is depressed, it will cause locking cylinder 82 to travel in the direction of arrow 84, thereby aligning orifice 30 with locking tab 74 and allowing their engagement. This type of locking cylinder arrangement, and similar arrangements, are well known to those skilled in the art and are described, e.g., in U.S. Pat. Nos. 5,855,129, 5,472,313, 5,288,210, 5,275,534, 5,236,302, and the like. The disclosure of each of these United States patents is hereby incorporated by reference into this specification.

Figure 9:
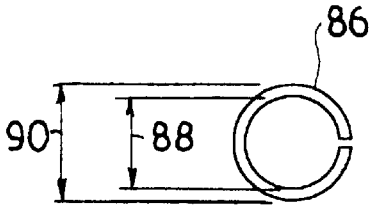
FIG. 9 is a front view of a shim disposed within the brackets of the locking device of FIG. 1.
Figure 10:
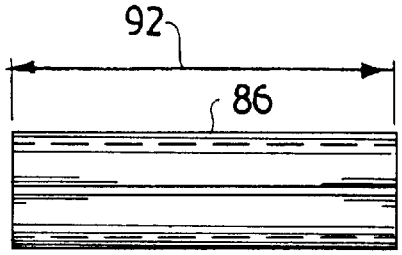
FIG. 10 is side view of the shim of FIG. 9.

FIG. 9 is an end view of a shim 86 which may be disposed within orifices 48 and 50 (see FIG. 1); and FIG. 10 is a side view of shim 86. As will be apparent to those skilled in the art, ski poles, such as ski pole 18, come in a variety of diameters, generally varying from about 0.515" to about 0.750 in diameter. The locking device 10 is preferably equipped with a multiplicity of shims 86 of varying internal diameters. In one embodiment, the internal diameter 88 is from about 0.515" to about 0.560", and the external diameter 90 of shim 86 is preferably a about 0.750 inches. The length 92 of shim(s) 86 is generally from about 2.4 to about 2.5 inches.

Figure 11:
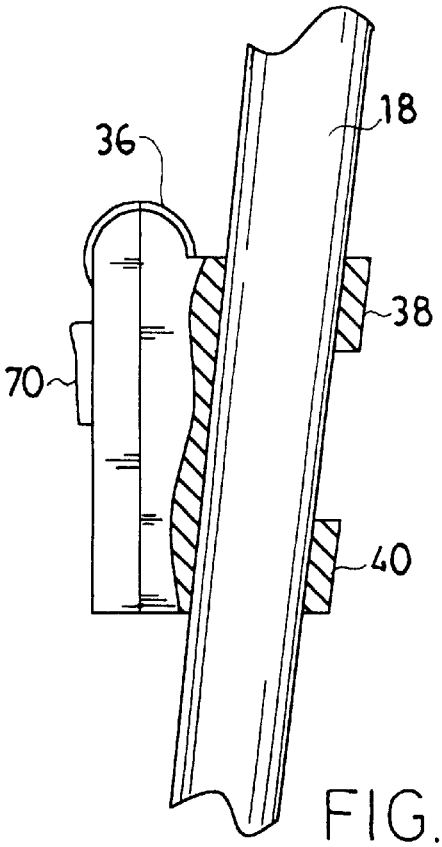
FIG. 11 is a sectional view of a ski pole disposed within the brackets of the locking device of FIG. 1 without a shim.
Figure 12:
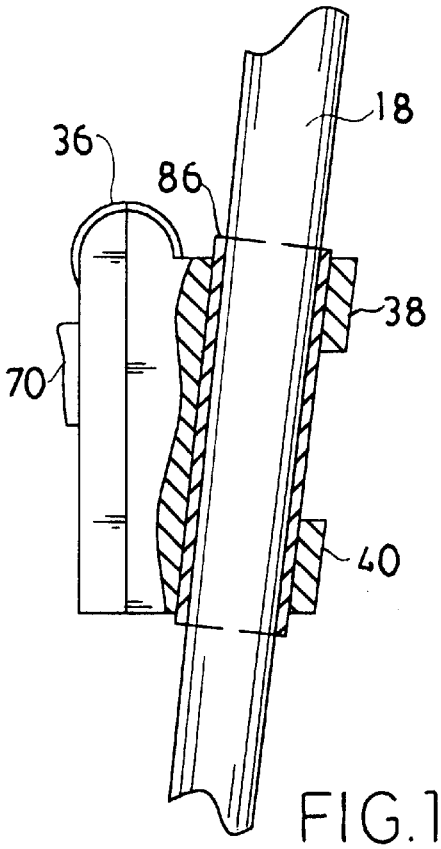
FIG. 12 is a sectional view of the a ski pole disposed within the shim of FIG. 9 which, in turn, is disposed within the brackets of the locking device of FIG. 1.

FIG. 11 illustrates an embodiment wherein shim 86 is not disposed within orifices 48 and 50, whereas FIG. 12 illustrates an embodiment wherein shim 86 is so disposed within orifices 48 and 50.

Figure 13:
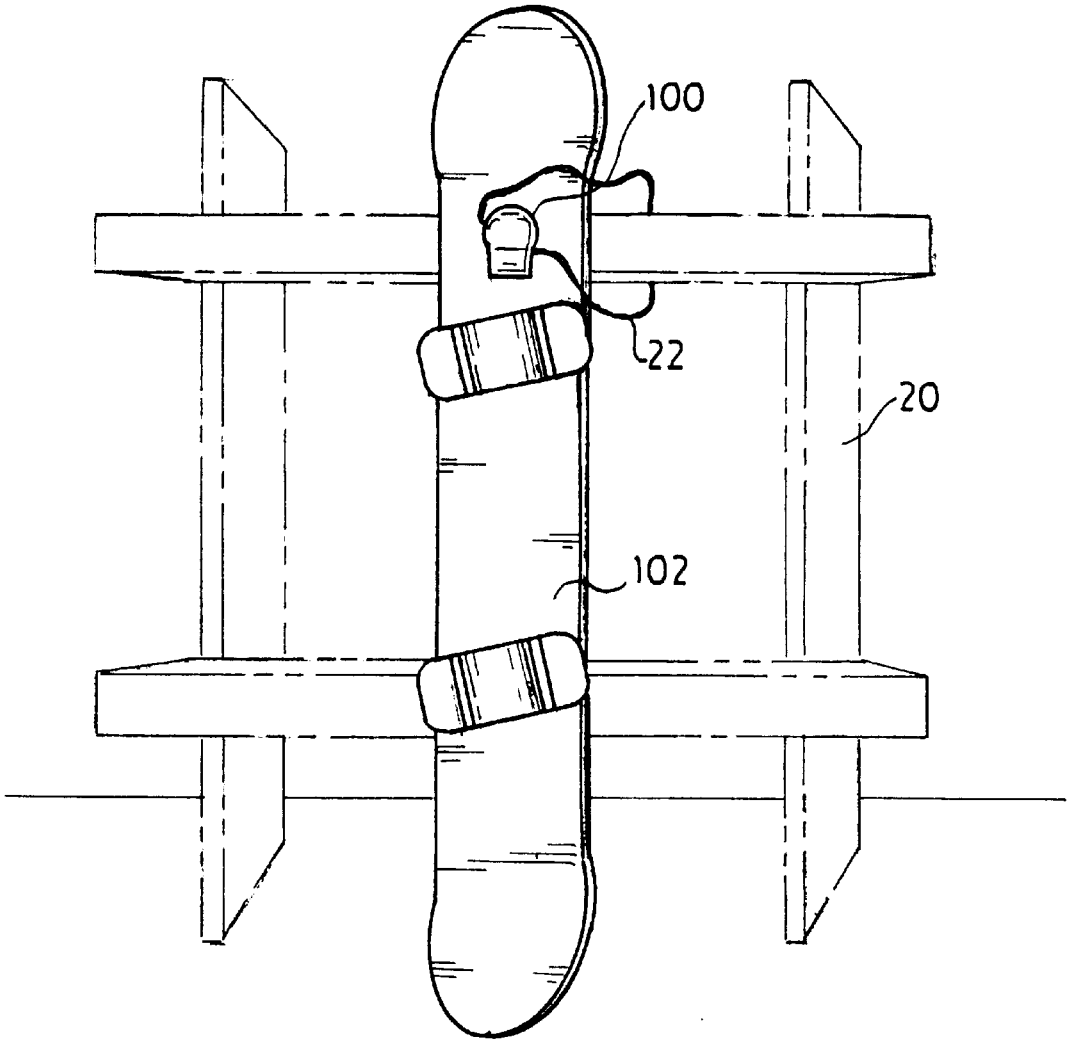
FIG. 13 is a perspective view of another locking device of this invention securing a snowboard to a stand.

FIG. 13 is a perspective view of another locking device 100 being used to secure a snowboard 102 to stand 20.

Figure 14:
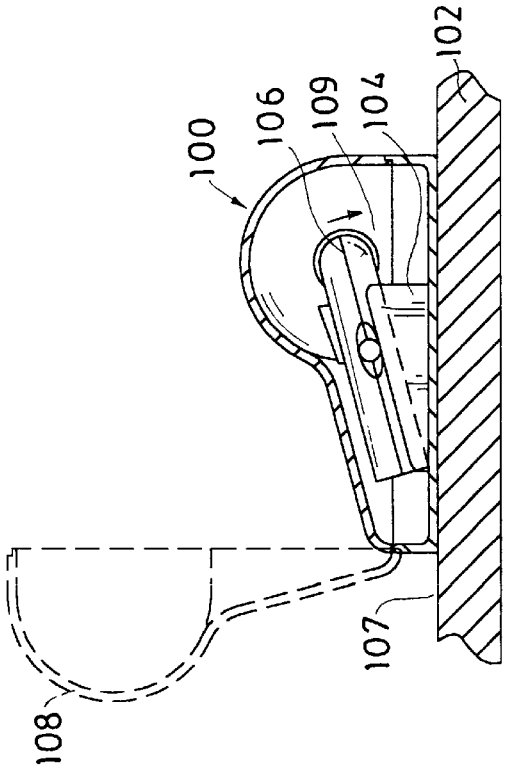
FIG. 14 is a side view of the locking device of FIG. 13 connected to such snowboard.

FIG. 14 is a side sectional view of the locking device 100 attached to snowboard 102. Any conventional attachment means may be used to secure the locking device 100 to the snowboard 102. By way of illustration and not limitation, one may use adhesive attachment means such as, e.g., "VHB ACRYLIC FOAM TAPE" sold by the Minnesota Mining and Manufacturing Corporation of Minneapolis, Minnesota as product number VHB4941.

Referring again to FIG. 14, and in the preferred embodiment depicted therein, it will be seen that a ramped shelf 104 is attached to the snowboard 102 by means of base 110, and, mounted therein is a cable lock assembly 106 which is substantially identical to the lock assembly 10 but differs therefrom in not containing the body 42 and the brackets 38 and 40. The lock assembly 106 is substantially identical to the "KRYTPONITE" combination lock with retractable cable which is referred to elsewhere in this specification.

In one embodiment, not shown, adhesive means are used to secure lock assembly 106 to ramped shelf 104. In another embodiment, not shown, a screw is used to secure lock assembly 106 to ramped shelf 104.

In the preferred embodiment depicted in FIG. 14, ramped shelf 104 is integrally and hingeably attached to cover 108 and base 110. As will be apparent to those skilled in the art, this arrangement prevents the entry of snow and other contaminants into the locking device but facilitates easy entry thereto whenever necessary.

Figure 17:
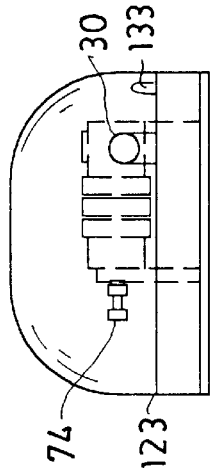
FIG. 17 is a front view of the locking device of FIG. 14.
Figure 15:
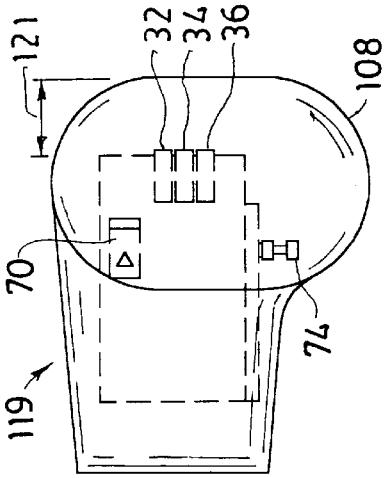
FIG. 15 is a top view of the locking device of FIG. 14.
Figure 16:
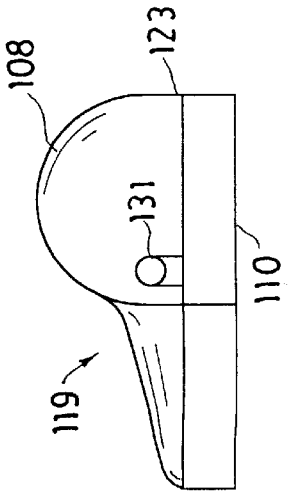
FIG. 16 is a right side view of the locking device of FIG. 14.
Figure 14A:
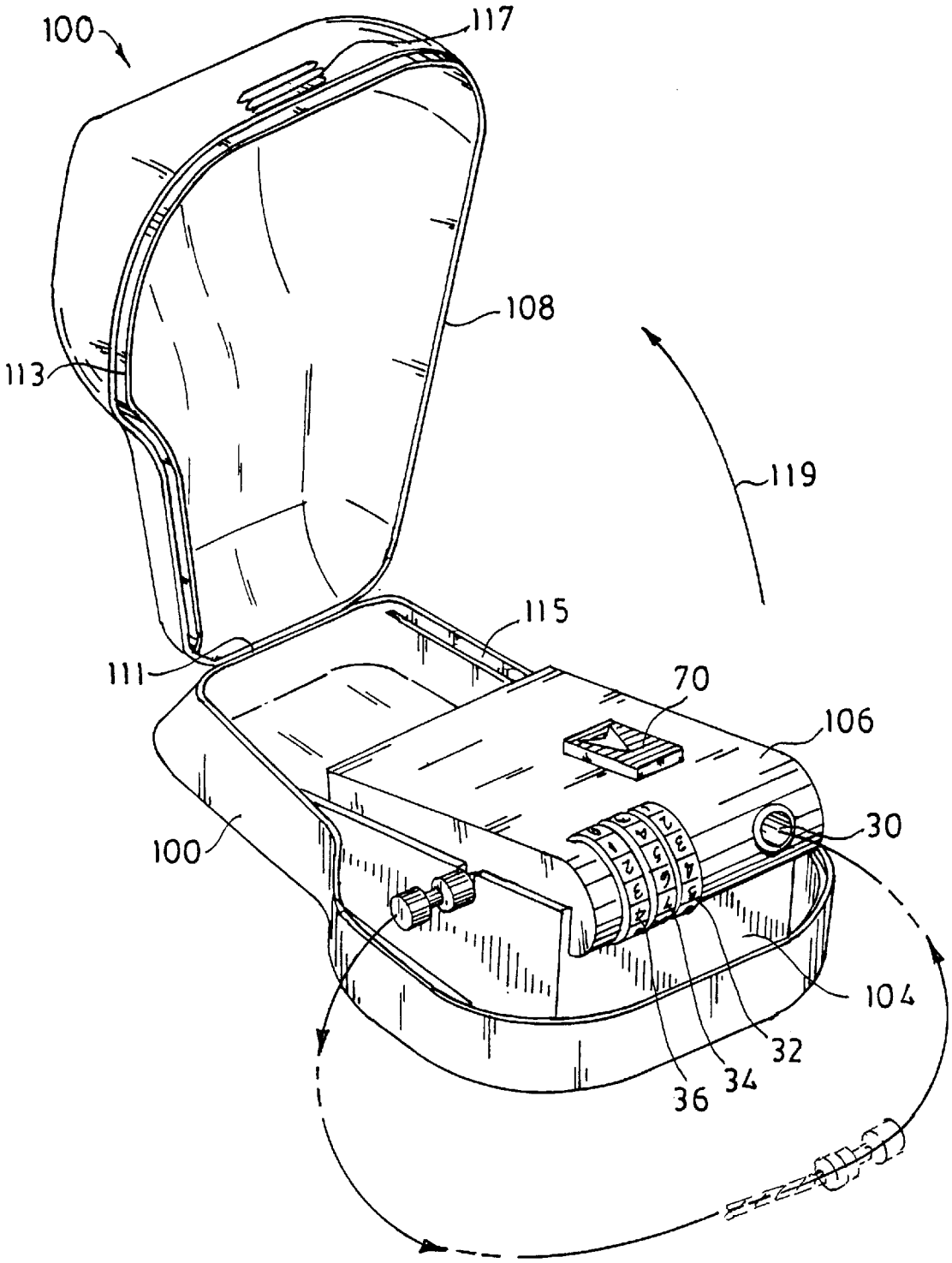

FIG. 15 is a top view of the assembly of FIG. 14, showing it in its closed position. FIG. 16 is a side view of the assembly of FIG. 15, from which detail of the locking device 106 has been omitted for the sake of simplicity of representation. FIG. 17 is a front schematic view of the device of FIG. 14.

Figure 18:
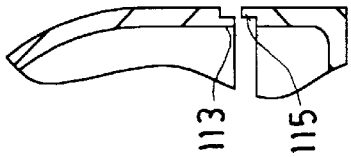
FIG. 18 is an enlarged sectional view of a portion of the device depicted in FIG. 17.

FIG. 18 is partial sectional view of the device of FIG. 14, illustrating how lips 114 and 116 interlockably engage each other when cover 108 is closed.

Figure 19:
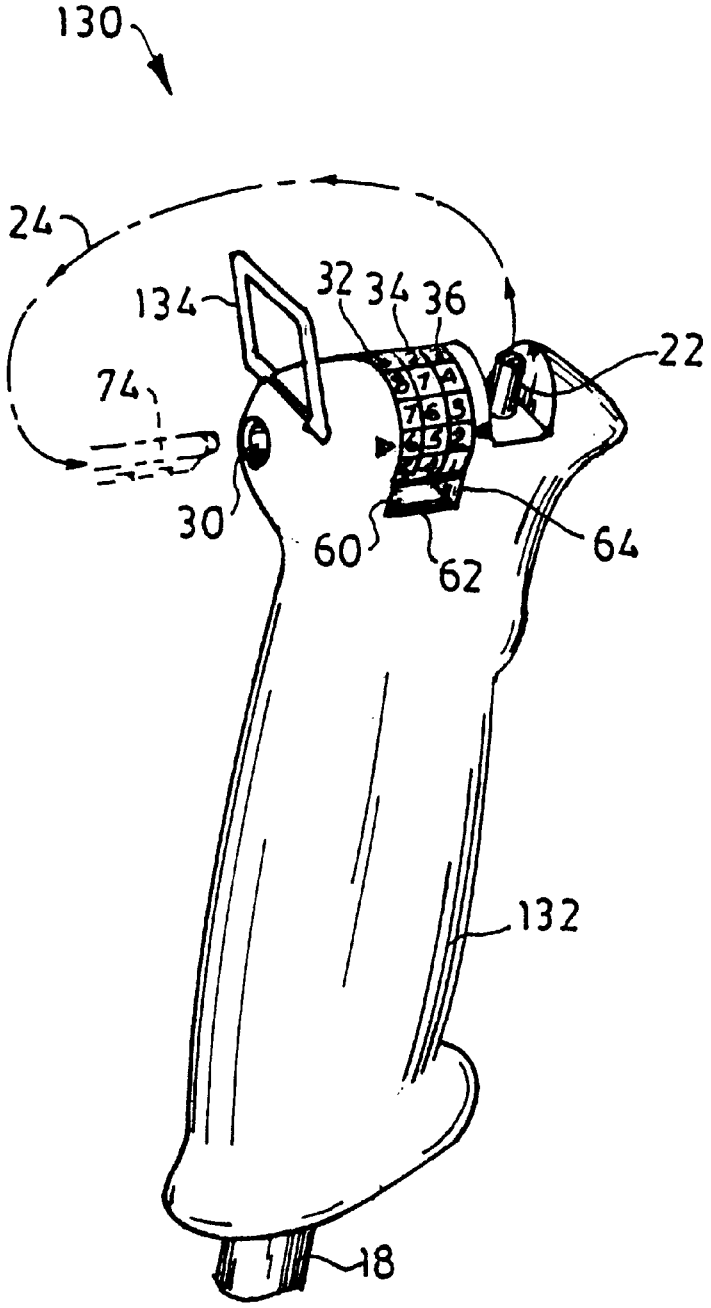
FIG. 19 is a perspective view of another preferred locking device of the invention.

FIG. 19 is a perspective view of another locking device 130 which functions in a manner similar to that of the device depicted in FIGS. 1 and 2 and has many of the same components such as, e.g., a barrel tumbler locking mechanism with a retactrable cable. As will be apparent to those skilled in the art, the device 130 differs from the device 10 in that the former device is comprised of a handle body 132 with an orifice (not shown) adapted to receive pole 18. By comparison, the body 42 of the device of FIG. 2 is attached to brackets 38 and 40, which brackets receive the ski pole 18. Otherwise, these devices are similar in structure and operation.

Referring to FIG. 19, it will be seen that, in the preferred embodiment depicted, body 132 is attached to a clip 134.

Figure 21:
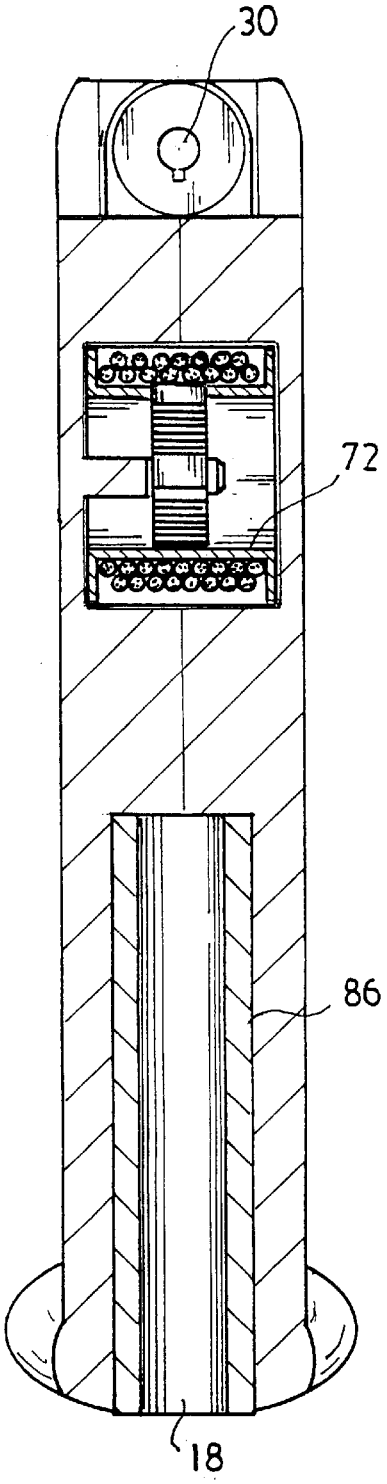
FIG. 21 is a front sectional view of the device of FIG. 19.
Figure 20:
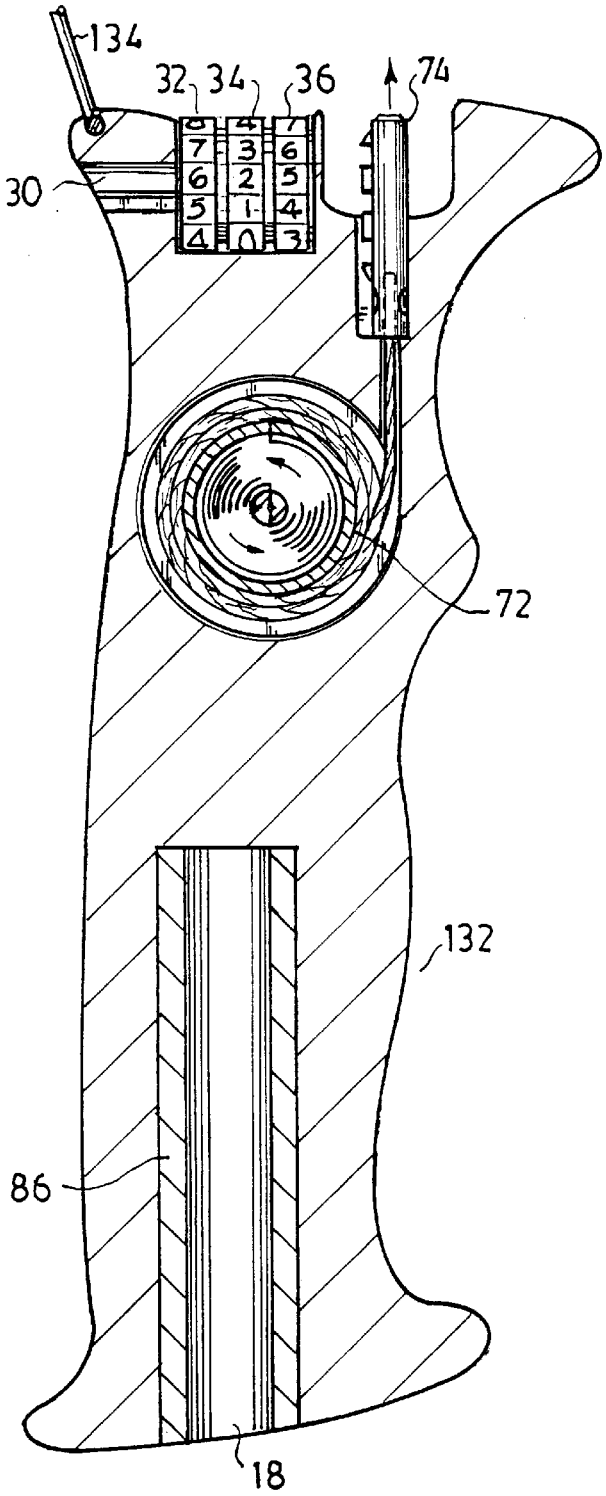
FIG. 20 is a side sectional view of the device of FIG. 19.

FIG. 20 is a sectional view of the device of FIG. 19. As will be apparent, the reel device 72 of FIGS. 20 and 21 operates in substantially the same manner as the reel device 72 of FIG. 8.

Referring to FIG. 20, and in the preferred embodiment depicted therein, it will be seen that a shim is being used to securely attach ski pole 18 within the body 132.

Figure 22:
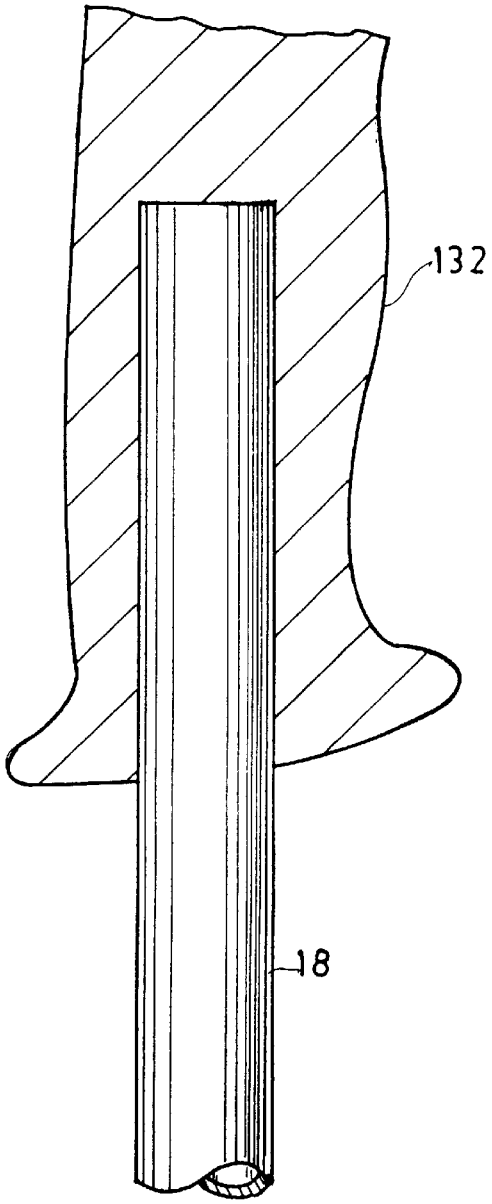
FIG. 22 is a partial sectional view of the device of FIG. 19, illustrating a ski pole disposed within such device without the use of a shim.
Figure 23:
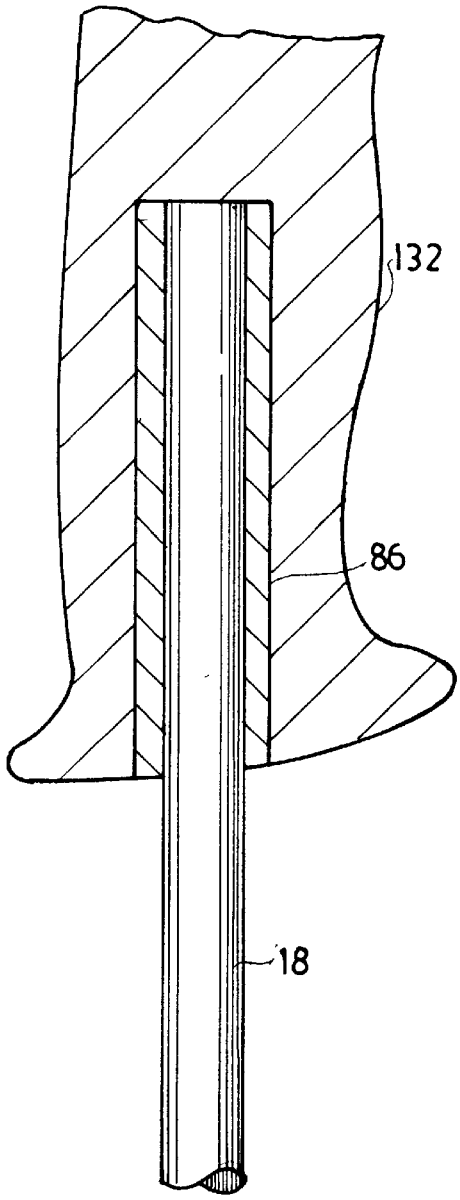
FIG. 23 is a partial sectional view of the device of FIG. 19, illustrating a ski pole disposed within such device with the use of a shim.

FIGS. 22 and 23 are partial sectional views which illustrate how the device of FIG. 20 can be used without a shim (FIG. 22) and with a shim (FIG. 23).

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A locking assembly for personal property, which comprises a body comprising a base, said body being connected to a combination lock with a retractable cable, a first bracket removably attached to said body, a second bracket removably attached to said body, wherein:

(a) said first bracket defines a first orifice with a first centerline, and said second bracket defines a second orifice with a second centerline, and (b) a line drawn through said first centerline and said second centerline forms an angle of from about 8 to about 15 degrees with respect to such base.

2. The locking assembly as recited in claim 1, wherein said body consists essentially of plastic material.

3. The locking assembly as recited in claim 2, wherein said plastic material is a polyester elastomeric material.

4. The locking assembly as recited in claim 3, comprising a spring-loaded reel assembly.

5. The locking assembly as recited in claim 4, comprising means for releasing said reel assembly.

* * * * *